US005189888A

United States Patent [19]

Anderson et al.

[11] Patent Number: 5,189,888

[45] Date of Patent: Mar. 2, 1993

[54] STILE HEATER FOR REFRIGERATOR

[75] Inventors: Vincent P. Anderson, Center Township, Vanderburgh County; Christopher G. Schmidt, Knight Township, Vanderburgh County, both of Ind.

[73] Assignee: Whirlpool Corporation, Benton Harbor, Mich.

[21] Appl. No.: 498,998

[22] Filed: Mar. 26, 1990

[51] Int. Cl.[5] ..... F25D 21/06

[52] U.S. Cl. ..... 62/248; 62/275

[58] Field of Search ..... 62/275, 248, 273, 80, 62/152

[56] References Cited

U.S. PATENT DOCUMENTS 3,254,503 6/1966 Rundell ..... 62/275

4,548,049 10/1985 Rajgopal ..... 62/275

FOREIGN PATENT DOCUMENTS 6609651 1/1967 Netherlands ..... 62/275

937002 9/1963 United Kingdom ..... 62/275

*Primary Examiner*—Harry B. Tanner

*Attorney, Agent, or Firm*—Wood, Phillips, VanSanten, Hoffman & Ertel

[57] ABSTRACT

A field installable service kit is disclosed for foamed in place refrigerator stile heaters that do not provide adequate heat around the front of the cabinet, to prevent external condensation under hot and humid conditions. The kit includes a transformer which is mounted on the back of the refrigerator by a service technician and connected directly in line with the stile heater wire connection. The transformer steps up the voltage from approximately 115 volts to approximately 160 volts, thereby approximately doubling the wattage on the resistance heater wire.

15 Claims, 4 Drawing Sheets

STILE HEATER FOR REFRIGERATOR

FIELD OF THE INVENTION

This invention relates to refrigerator anti-sweat heaters and, more particularly, to apparatus for improving heat output.

BACKGROUND OF THE INVENTION

In one form of a refrigeration apparatus cabinet, a mullion extends across the refrigerated space so as to form separated compartments within the outer cabinet. Conventionally, the mullion divides the refrigerated space into a freezer compartment and a fresh food compartment. The mullion may extend horizontally so as to provide vertically related compartments, or vertically so as to provide side-by-side related compartments.

One example of such a refrigeration apparatus having a horizontal mullion is illustrated in Rajgopal U.S. Pat. No. 4,548,049, which patent is owned by the assignee hereof. As shown therein, it is conventional to provide stile and mullion heaters for controlling condensation on the edge of the mullion and cabinet walls defining the refrigerated space normally closed by suitable doors.

The heaters conventionally provided for such anti-sweat or anti-condensation functioning are relatively low wattage heaters so as to minimize energy loss in eliminating condensation of moisture on the exposed wall surfaces. Further, it is conventional to provide the stile heater only about the freezer compartment where a greater problem of condensation is found.

The necessity of having stile and mullion heaters is dependent, in part, on the environment in which the refrigeration apparatus is used. Specifically, in relatively cool, dry climates, where condensation is less likely, there is less need for such heaters. However, in extremely humid climates, such heaters are quite necessary. For a manufacturer, a problem results in determining whether the refrigeration apparatus should be designed for a cool, dry climate or a hot, humid climate, while preserving economies of scale in manufacturing.

Current refrigerator designs install the anti-sweat heaters as close as possible to the metal surface. Although the mullion heater may be field accessible, the stile heater is typically inaccessible due to the foamed in place nature of insulating the cabinet.

To increase heat output under high temperature, high humidity conditions, it would be desirable to utilize a higher wattage heater. However, the stile heater could not be changed or modified in the field due, as discussed above. On some models, manufacturers include a service redundant stile heater which is normally unused. A service technician can, if necessary, electrically connect such a heater to provide additional heat output. On units which do not include such a redundant heater, there is no provision available for increasing heat output.

The present invention is directed to overcoming one or more of the problems as set forth above.

SUMMARY OF THE INVENTION

In accordance with the invention, a transformer is used to step up voltage applied to an anti-sweat heater.

Broadly, there is disclosed herein an improvement in a refrigeration apparatus including a cabinet provided with an inner liner to define an interior storage place and an electrical anti-condensation heater mounted at a select portion of the cabinet and connected to a source of electrical power to prevent external cabinet condensation. The improvement comprises means connected between the source of power and the heater for stepping up voltage applied to the heater to increase heat produced thereby.

It is a feature of the invention that the stepping up means comprises an auto transformer.

It is another feature of the invention that the auto transformer steps up the voltage by a factor of approximately 1.4.

It is yet a further feature of the invention that the auto transformer increases power from the heater by a factor of approximately 2.

In accordance with another aspect of the invention, there is disclosed herein a heater service kit for use with a refrigeration apparatus including a cabinet provided with an inner liner to define an interior storage space and an electrical anti-condensation heater mounted at a select portion of the cabinet and connected to a source of electrical power to prevent external cabinet condensation. The kit comprises a transformer mountable to the cabinet, and electrical connectors connected to the transformer for connection between the source of power and the heater to thereby to step up voltage applied to the heater to increase heat produced for preventing external condensation.

In accordance with yet a further aspect of the invention, there is disclosed herein a refrigeration apparatus including a cabinet provided with an inner liner to divide an interior storage space. An electrical anti-condensation heater is mounted at a select portion of the cabinet to prevent external cabinet condensation. A transformer is mounted to the cabinet. Electrical connectors connected to the transformer are provided for connection between a source of power and the heater to thereby step up voltage applied to the heater to increase heat produced for preventing external condensation.

In one embodiment of the invention, the heater comprises a stile heater mounted rearwardly of a front flange of the cabinet.

In another embodiment of the invention, the heater comprises a mullion heater mounted rearwardly of a mullion bar used as part of a separator wall secured to the liner to define first and second storage spaces.

In yet another embodiment of the invention, the heater comprises an ice/water dispenser heater mounted in association with an ice/water dispenser.

More specifically, the invention comprehends a field installable service kit for foamed in place refrigerator stile heaters that do not provide adequate heat around the front of the cabinet to prevent external condensation under hot and humid conditions. The kit includes a transformer which is mounted on the back of the refrigerator by a service technician and connected directly in line with the stile heater wire connection. The transformer steps up the voltage from approximately 115 volts to approximately 160 volts, thereby approximately doubling the wattage on the resistance heater wire.

Other features and advantages of the invention will readily be apparent from the specification and from the drawings.

DESCRIPTION OF THE INVENTION

Figure 1:
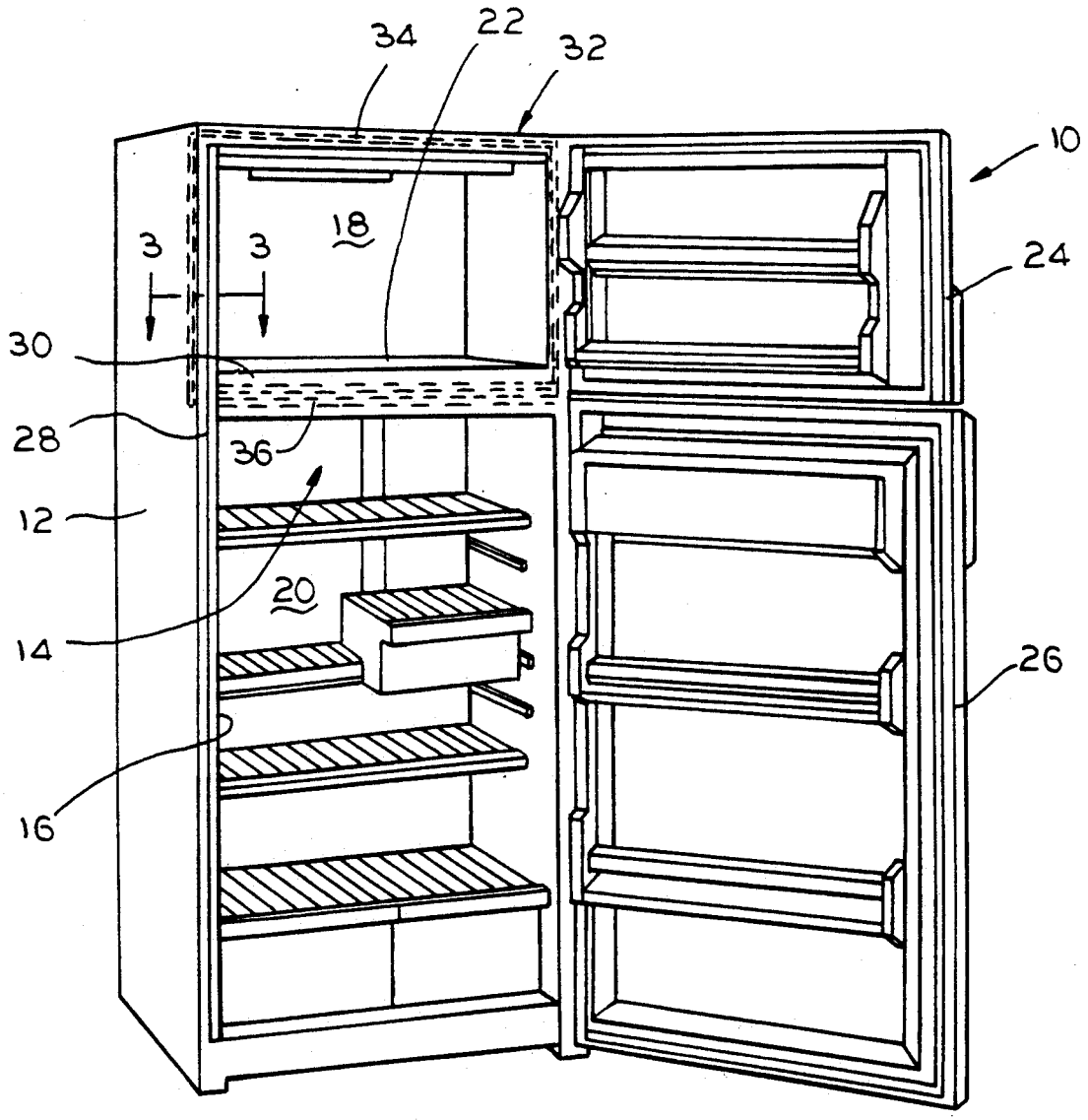
FIG. 1 is a perspective view of a refrigeration apparatus having anti-sweat heaters.

In the illustrated embodiment of the invention, a refrigeration apparatus 10 comprises a refrigerator-freezer apparatus having an outer cabinet 12 providing a refrigerated space 14 opening forwardly through an access opening 16. The refrigerated space 14 is divided into two compartments, including a freezer compartment 18, and an above-freezing fresh food refrigerator compartment 20, by a horizontal mullion wall 22. A freezer door 24 is hingedly mounted to the cabinet 12 for selectively closing the access opening to the freezer space 18 and a refrigerator door 26 is hingedly mounted to the cabinet 12 for selectively closing the access opening to the refrigerator compartment 20.

The present invention is concerned with the problem of eliminating condensation on the front surface 28 of the cabinet wall and a front surface of the mullion bar 30 extending about the freezer space 18. As illustrated generally, anti-sweat heaters 32 are provided in the form of a stile heater 34 and mullion heaters 36.

Figure 2:
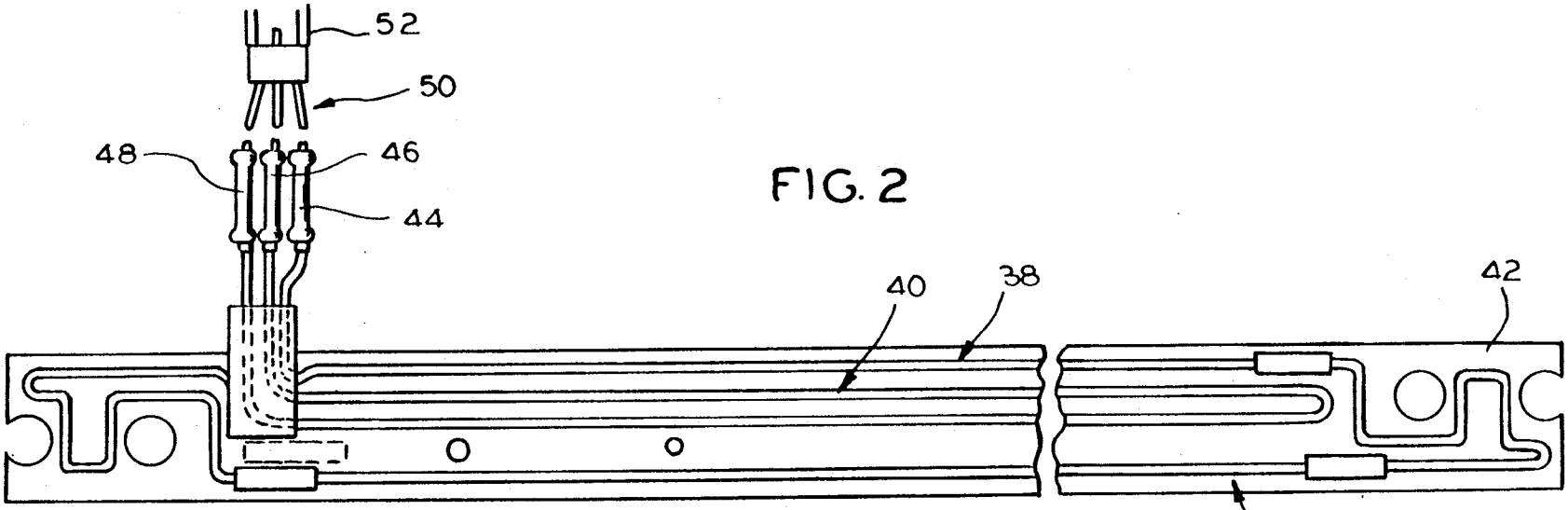
FIG. 2 is a front elevation of a mullion anti-sweat heater.

As shown in FIG. 2, the mullion heater 36 includes a pair of resistance heaters 38 and 40. The primary resistance heater 38 extends adjacent the periphery of a foil sheet 42 having a mylar film laminated to the surface thereof. The resistance heater 30 acts as a supplemental mullion heater and is disposed inwardly of the primary resistance heater 29. One end of each resistance heater 38 and 40 is connected to a respective terminal 44 and 46, while the opposite ends of both resistance heaters 38 and 40 are connected to a common terminal 48. The three terminals 44, 46 and 48 are connected by conductors 50 to a socket 52.

As is conventional, the foil/mylar base element 42 is mounted immediately rearwardly of the mullion bar 30 in any known manner. As such, electrical current passing through either resistance heater 38 or 40 produces heat so as to prevent condensation on the mullion bar 30.

Figure 3:
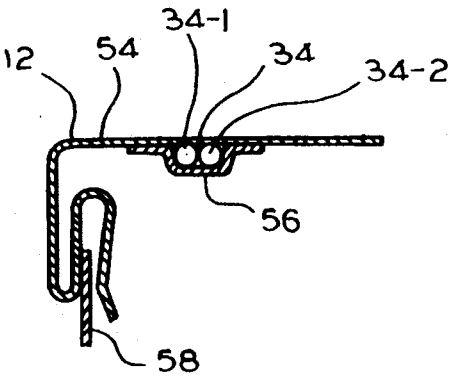
FIG. 3 is a sectional view taken along the line 3—3 of FIG. 1 illustrating a stile anti-sweat heater in greater detail.

With reference to FIG. 3, the stile heater 34 includes a first heater conductor 34-1 and a second heater conductor 34-2. The first heater conductor 34-1 comprises a heater cable having a first pre-selected value of resistance per unit length of cable and the second heater conductor 34-2 comprises a heater cable having a second, lower value of resistance per unit length of cable. The second heater conductor 34-2 comprises a very low resistance lead wire designed to close the circuit, not to produce heat. The stile heater 34 is retained in heat thermal transfer association with an outer wall 54 of the cabinet 12 by an adhesive tape 56. During manufacturing, a suitable insulation is foamed in place between the cabinet outer wall 54 and a plastic liner 58, as is well-known to permanently secure the stile heater 34.

Figure 4:
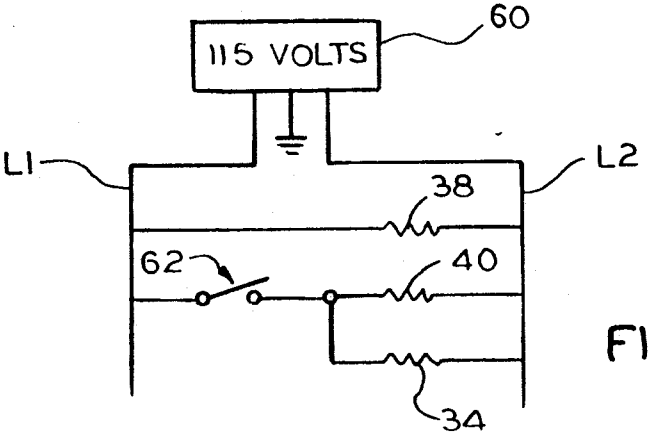
FIG. 4 is a simplified schematic diagram for the refrigeration apparatus of FIG. 1 illustrating electrical connections to the stile heater and mullion heaters.

With reference to FIG. 4, an electrical schematic diagram illustrates operation of the anti-sweat heaters 32. As will be appreciated, the schematic diagram of FIG. 4 comprises a simplified schematic diagram illustrating only those components in the refrigeration apparatus 10 relevant to the invention described and claimed herein.

The refrigeration apparatus 10 is powered by a conventional 115 volt/60 hertz AC power source 60 which provides opposite power across opposite power rails L1 and L2. The primary mullion resistance heater 38 is connected directly across the rails L1 and L2. Thus, during normal operation, the primary mullion heater 38 is energized.

Connected to the first rail L1 is a power saver switch 62, the opposite side of which it is connected in series with the parallel connection of the supplemental mullion resistance heater 40 and the stile heater 34 to the second rail L2. The power saver switch 62 is used to selectively enable or disable the resistance heaters 34 and 40. Specifically, under low temperature or low humidity conditions, the power saver switch may be positioned in its normally opened position, as illustrated in FIG. 4, to disable the heaters 34 and 40 and thus save power. Under higher temperature or higher humidity conditions, the power saver switch 62 can be moved to the closed position causing the heaters 34 and 40 to energize. When energized, the stile heater 34 prevents condensation around the front surface 28, see FIG. 1, while the supplemental mullion heater 40 adds additional heat to that produced by the primary mullion heater 38 in preventing condensation on the mullion bar 30.

Figure 5:
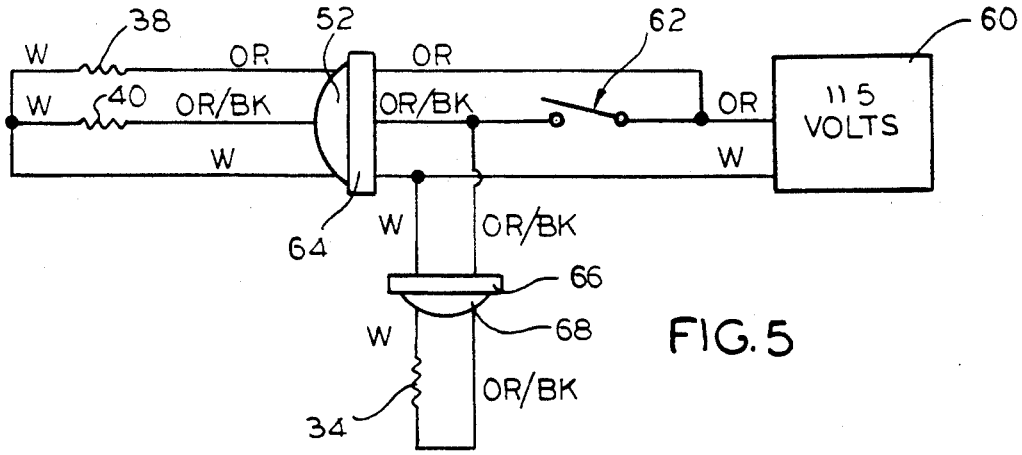
FIG. 5 is an electrical wiring diagram relating to the schematic of FIG. 4.
Figure 10:
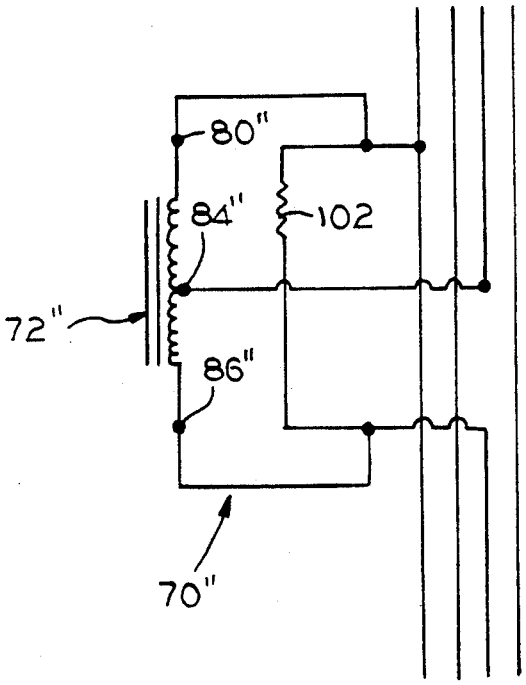

With reference to FIG. 5, an electrical wiring diagram illustrates actual connections used in the refrigeration apparatus of FIG. 10 to implement the schematic shown in FIG. 4. The wiring diagram illustrates conductors having color designations identifying the conductors. Specifically, the designator W is used for white, the designator OR is used for orange, and the designator OR/BK for orange/black.

The power source 60 is connected to an orange conductor and a white conductor, comprising the rails L1 and L2. The orange conductor is connected to one side of the power switch 62, the other side of which is connected to an orange/black conductor. Each of the three conductors is connected through a plug 64 mated with the socket 52 for connection to the mullion resistance heaters 38 and 40. The white and the orange/black conductors are connected through a second plug 66 and through a mated socket 68 to the stile heater 34.

Figure 6:
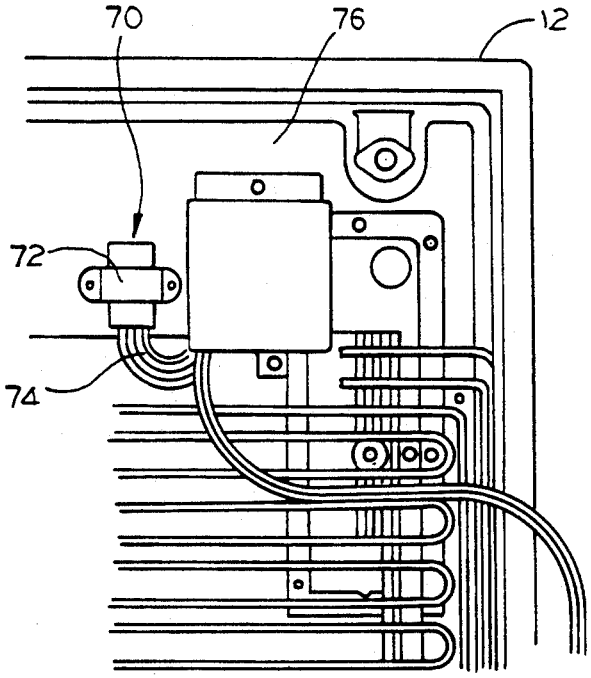
FIG. 6 is a rear elevation view of the heater service kit mounted to the rear wall of the refrigeration apparatus of FIG. 1.

Under extreme high temperature or humidity conditions, the factory installed anti-sweat heaters 32 may produce insufficient heat to prevent condensation. With respect to the stile heater 34, it is virtually impossible to replace the installed stile heater with a higher wattage heater. This is due to the heater being rendered permanently installed by use of the foamed in place insulation. Although the mullion heaters 38 and 40 could be more readily replaced, it may not be desirable to do so. In accordance with the invention, a heater transformer service kit 70, see FIG. 6, may be used as a service fix in the field. The service kit 70 comprises an auto transformer 72 having suitable conductors 74 pre-wired thereto. A service technician mounts the transformer 70 on a rear wall 76 of the cabinet 12 and connects the conductors 74 directly in line with the anti-sweat heater wire connections. In the illustrated embodiment, the auto transformer 72 steps up the 115 volt input voltage to about 160 volts. This approximately doubles the wattage on the resistance heater wire.

Figure 7:
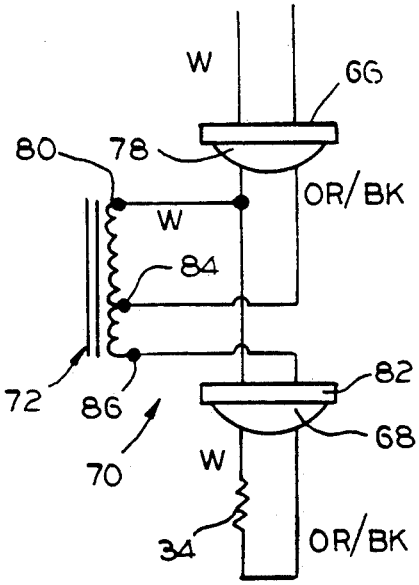
FIG. 7 illustrates a modification to the wiring diagram of FIG. 5 using the heater service kit in connection with a stile heater.

With reference to FIG. 7, a service kit 70 is illustrated for use in boosting voltage to the stile heater 34. The kit 70 comprises a socket 78 matable with the stile heater plug 66 and having a white conductor connected to a common tap 80 on the auto transformer 72. The white conductor is also connected to a plug 82 which connects to the stile heater socket 68. An orange/black conductor from the socket 78 is connected to a mid-range tap 84 of the auto transformer, while a high voltage tap 86 is connected to the plug 82.

To install the stile heater transformer service kit 70, the plug 66 and socket 68, see FIG. 5, are uncoupled, and the plug 66 is instead inserted to the socket 78 of the kit. Similarly, the kit plug 82 is inserted in the stile heater socket 68 as shown in FIG. 7. As a result, the 115 volt input is applied between the auto transformer common and mid range taps 80 and 84, while the output to the heater is placed across the common tap 80 and the high voltage tap 86. As a result, the voltage on the range of 160 volts is applied to the stile heater 3 thereby approximately doubling the power output of the stile heater 34.

Figure 8:
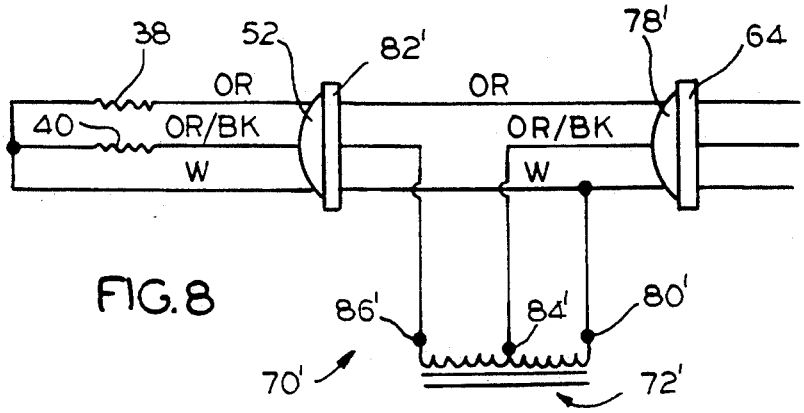
FIG. 8 illustrates a modification to the wiring diagram of FIG. 5 using the heater service kit in connection with a mullion heater.

With reference to FIG. 8, a wiring diagram of a mullion heater transformer service kit 70', similar to the kit 70, is illustrated. For simplicity, like elements are referenced with like, primed reference numerals. The principal difference between the two kits is the addition of an orange conductor extending between the kit socket 78' and plug 82' for providing a direct connection to the primary mullion resistance heater 38. Otherwise, the kit 70' is mounted in a similar manner and is operable to step up voltage across the supplemental mullion resistance heater 40 from approximately 115 volts AC to 160 volts AC.

Figure 9:
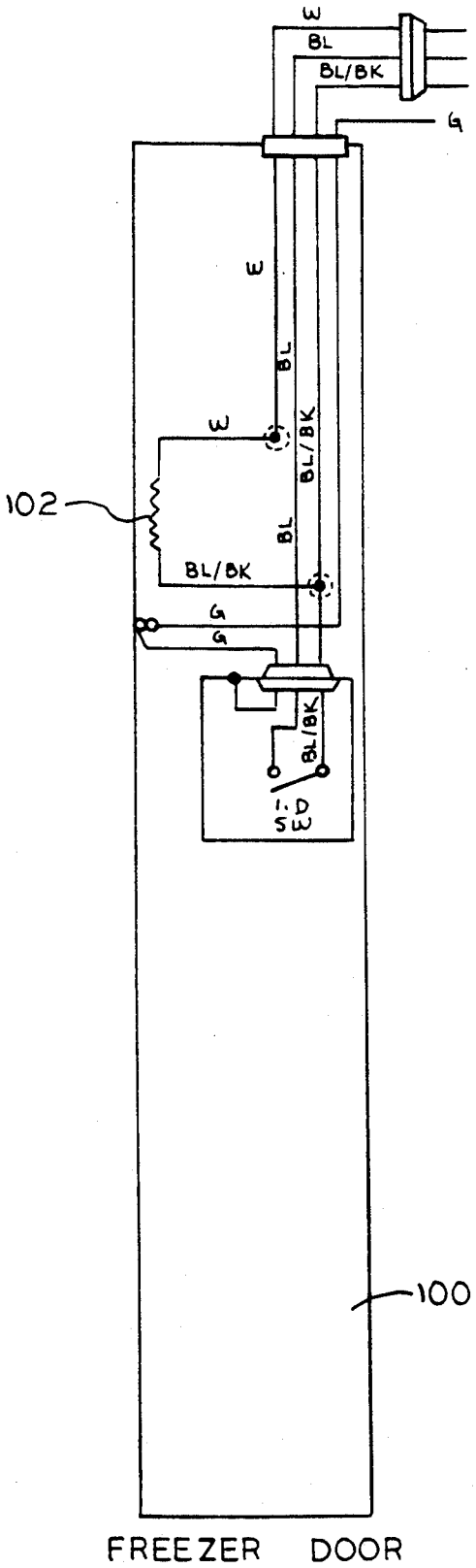
FIG. 9 illustrates a freezer door for a side-by-side refrigerator including a wiring diagram of an ice/water dispenser housing heater; and, FIG. 10 illustrates a modification to the wiring diagram of FIG. 9 using the heater service kit in connection with an ice/water dispenser housing heater.

With reference to FIG. 9, a freezer door 100 is illustrated for use with a side-by-side refrigerator/freezer (not shown), including an ice/water dispenser mounted in the door 100. Although the dispenser is not specifically shown therein the ice/water dispenser housing includes a resistance heater 102, illustrated schematically, connected in series to a white conductor and a blue/black conductor which are together connected to a power source to prevent condensation on the housing.

With reference to FIG. 10, a housing heater transformer service kit 70" according to a third embodiment of the invention is illustrates. Specifically, the wiring diagram is modified to illustrate connections between the kit 70" and the housing heater 102. As above, the 115 volt input power is connected between the transformer common and mid range taps 80" and 84", while the housing heater 102 is connected across the other transformer common tap 80" and high voltage tap 86" to again approximately double the wattage on the housing heater.

Thus, in accordance with the invention, there is described a field installable anti-sweat heater transformer service kit which permits simple upgrading of power produced by an anti-sweat heater in a previously assembled refrigeration apparatus.

The illustrated embodiment of the invention is illustrative of the broad inventive concepts comprehended hereby.

We claim:

1. In a refrigeration apparatus including a cabinet provided with an inner liner to define an interior storage space and an electrical anti-condensation heater mounted at a select portion of said cabinet and connected to a source of electrical power to prevent external cabinet condensation, the improvement comprising:

means connected between said source of power and said heater for stepping up voltage applied to said heater to increase heat produced thereby.

2. The improvement of claim 1 wherein said stepping up means comprises an auto transformer.

3. The improvement of claim 2 wherein said auto transformer steps up the voltage by a factor of approximately 1.4.

4. The improvement of claim 2 wherein said auto transformer increases power from said heater by a factor of approximately 2.0.

5. In a refrigeration apparatus including a cabinet provided with an inner liner to define an interior storage space and an electrical anti-condensation heater mounted at a select portion of said cabinet and connected to a source of electrical power to prevent external cabinet condensation, a heater service kit comprising:

a transformer mountable to said cabinet; and electrical connectors connected to said transformer for connection between said source of power and said heater to thereby step up voltage applied to said heater to increase heat produced for preventing external condensation.

6. The heater service kit of claim 5 wherein said transformer comprises an auto transformer.

7. The heater service kit of claim 6 wherein said auto transformer steps up the voltage by a factor of approximately 1.4.

8. The heater service kit of claim 6 wherein said auto transformer increases power from said heater by a factor of approximately 2.0.

9. A refrigeration apparatus comprising:

a cabinet provided with an inner liner to define an interior storage space;

an electrical anti-condensation heater mounted at a select portion of said cabinet to prevent external cabinet condensation;

a transformer mounted to said cabinet; and electrical connectors connected to said transformer for connection between a source of power and said heater to thereby step up voltage applied to said heater to increase heat produced for preventing external condensation.

10. The refrigeration apparatus of claim 9 wherein said transformer comprises an auto transformer.

11. The refrigeration apparatus of claim 10 wherein said auto transformer steps up the voltage by a factor of approximately 1.4.

12. The refrigeration apparatus of claim 10 wherein said auto transformer increases power from said heater by a factor of approximately 2.0.

13. The refrigeration apparatus of claim 9 wherein said heater comprises a stile heater mounted rearwardly of a front flange of said cabinet.

14. The refrigeration apparatus of claim 9 wherein said heater comprises a mullion heater mounted rearwardly of a mullion bar used as part of a separator wall secured to said liner to define first and second storage spaces.

15. The refrigeration apparatus of claim 9 wherein said heater comprises an ice/water dispenser heater mounted in association with an ice/water dispenser.

* * * * *